US009741326B2

(12) United States Patent
Oh et al.

(10) Patent No.: US 9,741,326 B2
(45) Date of Patent: Aug. 22, 2017

(54) ELECTRONIC DEVICE SUPPORTING MUSIC PLAYING FUNCTION AND METHOD FOR CONTROLLING THE ELECTRONIC DEVICE

(71) Applicant: Samsung Electronics Co., Ltd., Suwon-si, Gyeonggi-do (KR)

(72) Inventors: Hae-Seok Oh, Gumi-si (KR); Jeong-Yeon Kim, Daegu (KR); Dae-Beom Park, Gumi-si (KR); Lae-Hyuk Bang, Gumi-si (KR); Chul-Hyung Yang, Gumi-si (KR); Ji-Woong Oh, Gumi-si (KR); Gyu-Cheol Choi, Gumi-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 432 days.

(21) Appl. No.: 14/467,416

(22) Filed: Aug. 25, 2014

(65) Prior Publication Data

US 2015/0067517 A1 Mar. 5, 2015

(30) Foreign Application Priority Data

Aug. 27, 2013 (KR) ..... 10-2013-0101872

(51) Int. Cl.
*G10H 1/36* (2006.01)
*G10H 1/00* (2006.01)

(52) U.S. Cl.
CPC ..... *G10H 1/36* (2013.01); *G10H 1/0041* (2013.01); *G10H 2210/005* (2013.01); *G10H 2210/056* (2013.01); *G10H 2220/096* (2013.01); *G10H 2240/131* (2013.01)

(58) Field of Classification Search
CPC ..... G10H 2210/091; G10H 2240/325; G10H 2210/105; G10H 2210/101; G10C 3/12; G10C 5/00; G10D 3/12; G10D 3/14; G10D 3/143; G10D 1/085; G10D 3/04; G10D 3/10; G10D 3/146; G10D 11/00; G10D 1/08; G10D 3/00; G10G 3/04; G10G 1/02
See application file for complete search history.

(56) References Cited

U.S. PATENT DOCUMENTS 8,629,342 B2 * 1/2014 Lee ..... G09B 15/00 84/477 R
2005/0252362 A1 * 11/2005 McHale ..... G10H 1/368 84/616
2010/0307321 A1 * 12/2010 Mann ..... G06F 3/0481 84/613
2010/0313736 A1 * 12/2010 Lenz ..... G09B 15/02 84/477 R
2012/0132057 A1 * 5/2012 Kristensen ..... G09B 15/00 84/650
2013/0053114 A1 2/2013 Nishimura et al.
2014/0053710 A1 * 2/2014 Serletic, II ..... G10H 7/00 84/609
2014/0053711 A1 * 2/2014 Serletic, II ..... G10H 1/38 84/611

* cited by examiner

*Primary Examiner* — Marlon Fletcher
(74) *Attorney, Agent, or Firm* — Jefferson IP Law, LLP

(57) ABSTRACT

An electronic device and a method for controlling the electronic device are provided. The method includes receiving at least one input sound from a user, determining one of a plurality of reference sounds included in a guide track as a device playing sound corresponding to the at least one input sound, and playing the device playing sound.

23 Claims, 9 Drawing Sheets

ELECTRONIC DEVICE SUPPORTING MUSIC PLAYING FUNCTION AND METHOD FOR CONTROLLING THE ELECTRONIC DEVICE

CROSS-REFERENCE TO RELATED APPLICATION(S)

This application claims the benefit under 35 U.S.C. §119 (a) of a Korean patent application filed on Aug. 27, 2013 in the Korean Intellectual Property Office and assigned Serial number 10-2013-0101872, the entire disclosure of which is hereby incorporated by reference.

TECHNICAL FIELD

The present disclosure relates to an electronic device supporting a music playing function and a method for controlling the electronic device. More particularly, the present disclosure relates to providing a novice user who is not familiar with playing an instrument direction so that they may easily learn to play the instrument.

BACKGROUND

Recently, a play application or a music playing application provides a User Interface (UI) that looks like a real musical instrument, that is, a musical instrument (or instrument) UI to a user to allow the user to play the musical instrument in the same manner as playing the real musical instrument. The music playing application displays piano keys on a screen and creates sound corresponding to keys touched by the user.

In another use, the user may in advance, select background music and/or music to be played and input it to the music playing application. Once the user inputs a play start command to the music playing application, the music playing application displays notes to be played by the user on an execution screen on which an instrument is displayed. For example, suppose that the musical instrument of the music playing application is the piano. For playing of music selected by the user, the music playing application may guide the user by sequentially displaying a key to be touched by the user differently than keys that are not touched.

However, when only the musical instrument UI is provided to the user, the user may have a difficulty in playing the musical instrument unless he or she already knows how to play the musical instrument proficiently. Moreover, when the user selects in advance music to be played and plays the music following the guidance of the application, the user may play only music provided by the application.

Accordingly, an electronic device and a method for controlling the electronic device, in which a novice user who is not familiar with playing an instrument may play the musical instrument with proficiency.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide an electronic device and a method for controlling the electronic device, in which a novice user who is not familiar with playing an instrument may play the musical instrument with proficiency.

In accordance with an aspect of the present disclosure, a method for controlling an electronic device is provided. The method includes receiving at least one input sound from a user, determining one of a plurality of reference sounds included in a guide track as a device playing sound corresponding to the at least one input sound, and playing the device playing sound.

In accordance with an aspect of the present disclosure, an electronic device supporting an instrument play function is provided. The electronic device includes an input/output module configured to receive a user input for determining playing music from a user, a controller configured to determine a guide track including a plurality of reference sounds according to the user input, to control the input/output module to receive at least one input sound from the user, and to determine one of a plurality of reference sounds included in the guide track as a device playing sound corresponding to the at least one input sound, and a multimedia module configured to play the device playing sound.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, like reference numerals will be understood to refer to like parts, components, and structures.

DETAILED DESCRIPTION

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein may be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
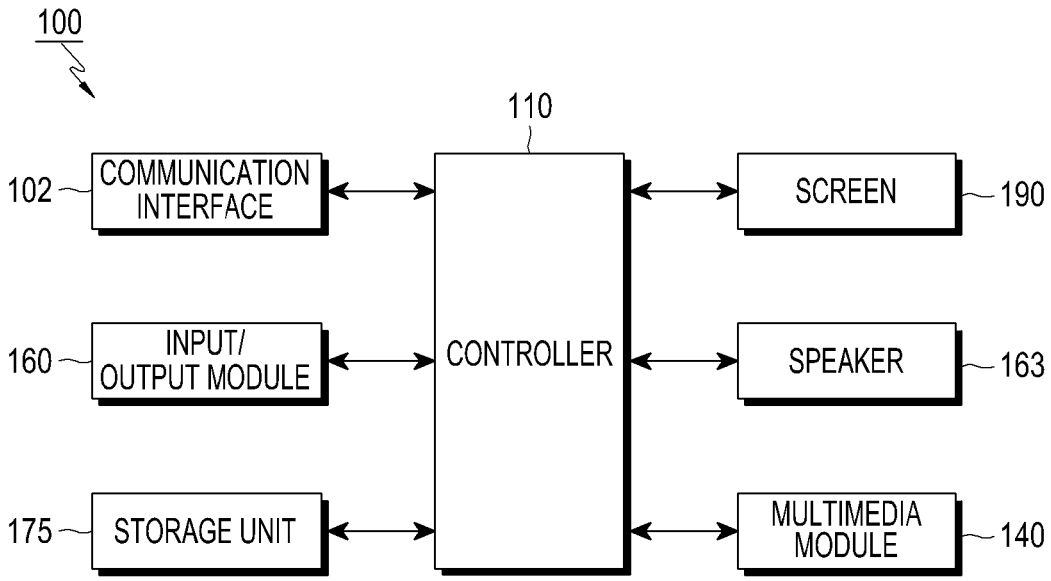
FIG. 1 is a block diagram illustrating an electronic device according to an embodiment of the present disclosure.

FIG. 1 is a block diagram illustrating an electronic device according to an embodiment of the present disclosure.

Referring to FIG. 1, an electronic device 100 may include a controller 110, a storage unit 175, and a screen 190, and may further include at least one of a communication interface 102, a multimedia module 140, an input/output module 160, and a speaker 163.

The communication interface 102 controls wired and/or wireless communication of the electronic device 100. The communication interface 100 according to the current embodiment may receive information associated with an application for playing an instrument (hereinafter, referred to as a music playing application) and/or receive the music playing application from another electronic device.

The controller 110 controls the overall operation of the electronic device 100. The controller 110 according to the current embodiment may be implemented in such a way to include a music playing application. The controller 110 executes the music playing application and controls the electronic device 100 to perform various operations corresponding to user inputs occurring during execution of the music playing application.

The controller 110 includes a Central Processing Unit (CPU), a Read Only Memory (ROM) in which a control program for controlling the electronic device 100 is stored, and a Random Access Memory (RAM) which memorizes a signal or data input from the electronic device 100 and/or is used as a memory region for a task performed in the electronic device 100. In an embodiment, a music playing application may be stored in the ROM of the controller 110. The CPU may include a single core, a dual core, a triple core, or a quad core processor. The CPU, the ROM, and the RAM may be interconnected through an internal bus.

The controller 110 according to the current embodiment analyzes a sound input from the user through the input/output module 160 and/or the screen 190 to determine a reference sound corresponding to the input sound, and controls the multimedia module 140 or the speaker 163 to output the reference sound as a device playing sound.

The controller 110 according to the current embodiment loads a guide track for determining device playing sounds corresponding to respective input sounds from the storage unit 175. According to an embodiment, the controller 110 may determine whether the guide track is stored in the storage unit 175 and control the communication interface 102 to request and receive the guide track from another electronic device (for example, a server storing the guide track) if the guide track is not stored. According to an embodiment, the controller 110 may generate a guide track for determining device playing sounds corresponding to respective input sounds. The guide track is a reference sound candidate group including a plurality of reference sounds. The 'reference sound' refers to a candidate sound that may be determined as a sound that is actually played (device playing sound) based on a sound input by the user (input sound). For example, the controller 110 may set 'fa sharp' or 'la flat' as a reference sound for sol, while generating a guide track. The 'sol' is an input sound and fa sharp or la flat is a reference sound. The controller 110 may determine one of fa sharp and la flat as a device playing sound corresponding to sol. For example, if the controller 110 determines la flat as a device playing sound corresponding to the input sound, sol, the la flat may be the device playing sound.

The controller 110 may determine a device playing sound corresponding to each input sound in various ways. The controller 110 may determine, as a device playing sound, a reference sound closest to an input sound from among reference sounds included in a guide track, that is, a reference sound candidate group. The controller 110 may also determine, as a device playing sound, a reference sound closest to an input sound toward a higher sound from among the reference sounds included in the reference sound candidate group. According to an embodiment, the controller 110 may determine, as a device playing sound, a reference sound closest to an input sound toward a lower sound from among the reference sounds included in the reference sound candidate group.

According to an embodiment, if a plurality of input sounds are input at the same time, the controller 110 may determine an octave including the most input sounds as a main octave, and determine one of the reference sounds included in the main octave as a device playing sound corresponding to each input sound. For example, suppose that two of three input sounds that are input to the electronic device 100 at the same time are included in a first octave and the remaining one input sound is included in a second octave. The controller 110 may determine the first octave as a main octave and determine reference sounds included in the first octave as device playing sounds corresponding to the respective three input sounds. The controller 110 may determine, as a device playing sound, a reference sound closest to an input sound among the reference sounds included in the main octave. The controller 110 may also determine, as a device playing sound, a reference sound closest to an input sound toward a higher sound among the reference sounds included in the main octave. The controller 110 may also determine, as a device playing sound, a reference sound closest to an input sound toward a lower sound among the reference sounds included in the main octave.

A device playing sound corresponding to an input sound may be determined based on a reference value stored in the storing unit 175 in advance, or based on an input value input from the user during execution of the music playing application.

Once a device playing sound corresponding to an input sound is determined, the controller 110 controls the multimedia module 140 to play the device playing sound and controls the speaker 163 to output the device playing sound.

In the current embodiment, the controller 110 may load one guide track or a plurality of guide tracks, for an instrument played using the music playing application. That is, there may be a plurality of guide tracks for one musical instrument. For example, assume that the user plays a guitar by using the music playing application. The controller 110 according to the current embodiment may load a guide track for a lead guitar and a guide track for a rhythm guitar as guide tracks for an electric guitar.

In an embodiment, once the user selects a particular musical instrument through the music playing application, the controller 110 may determine a guide track corresponding to the selected musical instrument or corresponding to an instrument that is the most similar to the selected musical instrument as a guide track for the musical instrument selected by the user, and load the determined guide track. For example, if the user desires to play an electric guitar through the music playing application, the controller 110 may load a guide track for a lead guitar, a guide track for a rhythm guitar, and a guide track for a base guitar, as guide tracks for the electric guitar.

The controller 110 according to the current embodiment controls the input/output module 160 or the screen 190 to receive a user input for selecting one of the plurality of guide tracks. In an embodiment, the controller 110 determines a guide track having the highest similarity to the input sound among the plurality of guide tracks as a guide track to be applied to the input sound. The similarity is determined by the controller 110, and the controller 110 determines a guide track having an instrument sound that is the same as or the most similar to an instrument sound of the input sound as the guide track having the highest similarity and applies the determined guide track to the input sound.

In an embodiment, the controller 110 analyzes the input sound input from the user to determine whether a device playing sound for the input sound corresponds to a guide track for a lead guitar, a guide track for a rhythm guitar, or a guide track for a base guitar. That is, the controller 110 according to the current embodiment analyzes the input sound and determines a guide track applicable to the input sound based on a result of the analysis. For example, if the input sound input by the user through the music playing application corresponds to a guide track for the rhythm guitar among the lead guitar, the rhythm guitar, and the base guitar, the controller 110 may determine the rhythm guitar as the musical instrument the user desires to play. That is, the controller 110 may apply the guide track for the rhythm guitar to the input sound input from the user to determine a device playing sound. The controller 110 plays a user playing sound of the lead guitar or the base guitar as background music, together with the device playing sound. In an embodiment, the controller 110 controls the electronic device 100 such that a user playing sound of the rhythm guitar is not played in the background music. That is, the user playing sound of the rhythm guitar may be played only as the device playing sound corresponding to the input sound input from the user.

According to an embodiment, the controller 110 may execute a group play in which playing music is played in concert with another electronic device, by using the music playing application. The controller 110 may regard a user playing sounds of musical instruments other than a user playing sound of an instrument played using the music playing application as background music. One melody may be played by a plurality of musical instruments, such that a guide track for each musical instrument may be loaded. The controller 110 may determine an instrument sound output by another electronic device as at least a part of background music. The controller 110 may control the multimedia module 140 to play background music other than the instrument sound output by the other electronic device and/or play the device playing sound corresponding to the input sound.

For example, suppose that playing music is played using five musical instruments: a lead guitar, a rhythm guitar, a base guitar, a main keyboard, and a second keyboard. Also suppose that a first electronic device plays an instrument sound of the lead guitar, a second electronic device plays an instrument sound of the rhythm guitar, a third electronic device plays an instrument sound of the base guitar, and a fourth electronic device plays an instrument sound of the main keyboard. The first electronic device may play only the instrument sound of the lead guitar and regard the instrument sounds output from the second to fourth electronic devices as background music. The first electronic device may also play the instrument sound of the lead guitar and at the same time, output an instrument sound of the second keyboard, which does not correspond to the instrument sounds played by the second to fourth electronic devices, as background music. The second through fourth electronic devices may output the instrument sounds of the rhythm guitar, the base guitar, and the main keyboard, respectively, because the first electronic device has already output the instrument sound of the second keyboard. The first electronic device may not output the instrument sounds output from the second to fourth electronic devices. According to an embodiment, the instrument sound of the second keyboard may be output as background music from one of the second to fourth electronic devices, rather than from the first electronic device.

In an embodiment, the instrument sound output from the electronic device 100 and the instrument sound output from another electronic device may be the same as each other. That is, a plurality of guide tracks may be provided for the same musical instrument. In this case, the controller 110 according to the current embodiment of the present disclosure may determine a device playing sound by applying one of the other guide tracks than a guide track applied to another electronic device among the plurality of guide tracks. For example, it is assumed that the instrument sound output from the first electronic device and the instrument sound output from the second electronic device are both piano sounds. The first electronic device may determine a device playing sound by applying a first guide track, and the second electronic device may determine a device playing sound by applying a second guide track. Thus, the piano sounds output from the first electronic device and the second electronic device may be different from each other.

In an embodiment, a guide track applied to a plurality of electronic devices may be one guide track for one musical instrument. That is, the plurality of electronic devices may apply the same guide track to output the same instrument sound. In this case, the electronic devices use different ways to determine a device playing sound corresponding to an input sound, such that different instrument sounds are output for the same musical instrument. For example, suppose that the instrument sounds output from the first electronic device and the second electronic device are both piano sounds. It is also assumed that one guide track is applied for the first electronic device and the second electronic device. According to the current embodiment, the first electronic device determines, as a device playing sound, a reference sound that is closest to an input sound toward a lower sound from a reference sound candidate group included in the guide track, and the second electronic device determines, as a device playing sound, a reference sound closest to an input sound toward a higher sound from a reference sound candidate group included in the guide track. Thus, the instrument sounds output from the first electronic device and the second electronic device may be different from each other.

In an embodiment, the controller 110 controls the screen 190 to control various contents displayed on the screen 190 or displaying of the contents. The controller 110 controls the electronic device 100 to perform an operation corresponding to a touch input, that is, a user input, sensed through the screen 190. Upon input of a touch input of touching at least a point on the screen 190, the controller 110 controls the electronic device 100 to perform an operation corresponding to the touch input. In an embodiment, the controller 110 controls the screen 190 to display an execution screen on which the music playing application is being executed.

The multimedia module 140 plays multimedia stored in the electronic device 100. In an embodiment, the multimedia module 140 plays device playing sounds determined corresponding to respective input sounds during execution of the music playing application. The multimedia module 140 may be implemented to be included in the controller 110.

The input/output module 160 receives a user input, inputted from the user. The input/output module 160 according to the current embodiment may receive a user input to execute the music playing application. In an embodiment, the input/output module 160 may receive a user input for selecting one of playing music stored in advance in the storage unit 175. The input/output module 160 may receive an input sound from the user. In an embodiment, the input/output module 160 may be implemented to include the screen 190.

The speaker 163 outputs sounds corresponding to various signals (for example, a wireless signal, a broadcast signal, a digital audio file, a digital video file, and a captured picture) stored in the electronic device 100 under control of the controller 110. The speaker 163 may also output sounds (for example, a button manipulation sound or a ring-back tone corresponding to a phone call) corresponding to a function performed by the electronic device 100. The speaker 163 according to the current embodiment may output device playing sounds determined by the controller 110.

Various data for controlling the electronic device 100 may be stored in the storage unit 175. The storage unit 175 may store signals or data that are input and output corresponding to operations of at least one of the communication interface 102, the multimedia module 140, the input/output module 160, the speaker 163, and the screen 190 under control of the controller 110. The storage unit 175 may also store a control program and applications for control of electronic device 100 and/or the controller 110. The storage unit 175 according to the current embodiment may store the music playing application and playing music, a guide track, a device playing sound, and so forth for operations of the music playing application.

The term "storage unit" includes the storage unit 175, a ROM, a RAM, and/or a memory card (not illustrated) mounted in the electronic device 100 (for example, a Secure Digital (SD) card and/or a memory stick). The storage unit 175 may include a non-volatile memory, a volatile memory, a Hard Disk Drive (HDD), and/or a Solid State Drive (SSD).

The screen 190 displays various data stored in the electronic device 100. The screen 190 according to the current embodiment displays an execution screen of the music playing application under control of the controller 110. The screen 190 receives an input sound inputted from the user, as an input for touching a point on the screen 190.

In an embodiment, the screen 190 displays a list including at least one playing music (hereinafter, referred to as a playing music list) under control of the controller 110. For example, the screen 190 may list and display titles of respective playing music to inform the user of playing music stored in the storage unit 175 of the electronic device 100. The user inputs a selection of one of the titles included in the playing music list to the screen 190, thereby selecting one of the playing music included in the playing music list as music to be played.

In an embodiment, the screen 190 may be implemented in the form of a touch screen to receive from a user a user input (touch input) occurring by a contact between a part of a body of the user (for example, a finger) and the screen 190. The screen 190 provides a User Interface (UI) corresponding to various services (for example, a call, data transmission, broadcasting, picture taking, and so forth) to the user. The screen 190 transfers an analog signal (touch input) corresponding to at least one touch input to the UI to the controller 110. The screen 190 receives at least one touch through a part of the user's body (for example, a finger including a thumb) and/or a touchable input means (for example, a stylus pen). The screen 190 also receives a continuous movement of one touch among at least one touch. The screen 190 transfers an analog signal corresponding to the input continuous movement of the touch to the controller 110. The controller 110 converts an analog signal received from the screen 190 into a digital signal (for example, X and Y coordinates) and controls the screen 190 by using the digital signal. For example, the controller 110 a shortcut icon (not illustrated) displayed on the screen 190 to be selected or executed in response to a touch.

In the present disclosure, a touch input may include not only a direct contact between a part of a user's body and/or a touchable input means, but also a non-contact touch (for example, when part of the user's body and/or the touchable input means is positioned within 5 cm from the screen 190, the part of the user's body and/or the touchable input means is detectable). The detectable distance from the screen 190 may vary according to the capability or structure of the electronic device 100.

Figure 2:
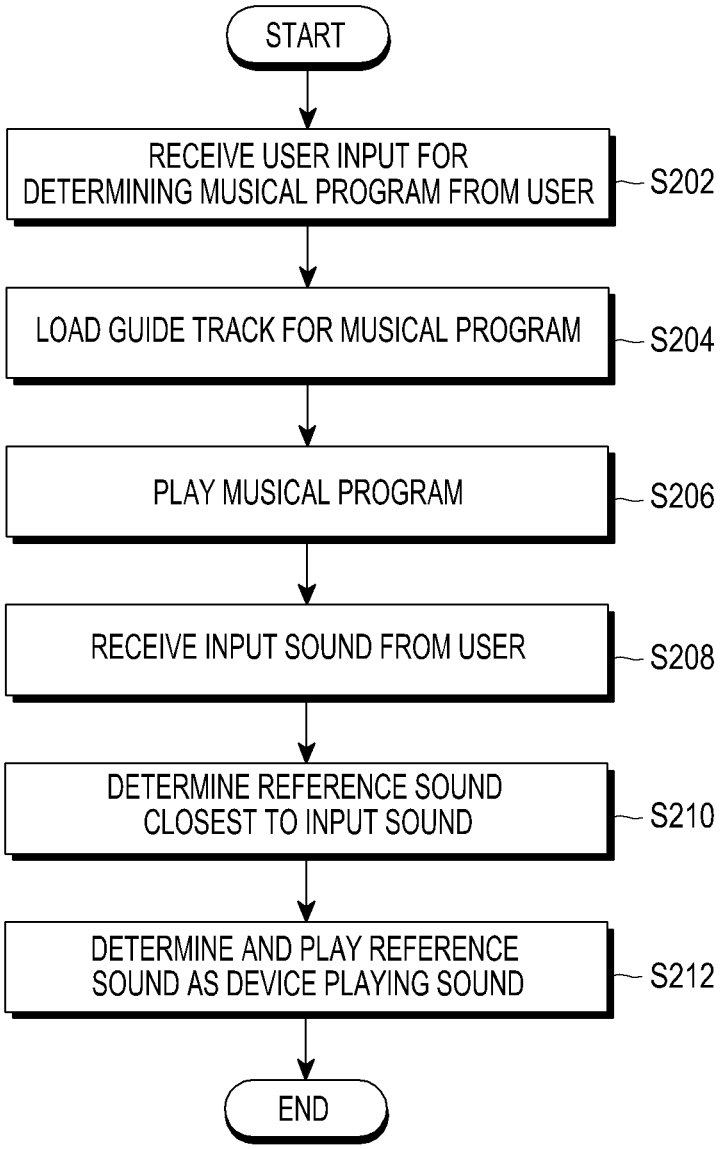
FIG. 2 is a flowchart illustrating an example of a method for controlling an electronic device, for example, the electronic device illustrated in FIG. 1, according to an embodiment of the present disclosure.

FIG. 2 is a flowchart illustrating an example of a method for controlling an electronic device, for example, the electronic devices illustrated in FIG. 1, according to an embodiment of the present disclosure. It is assumed that in FIG. 2, the electronic device 100 has already executed the music playing application.

Referring to FIG. 2, the electronic device 100 receives a user input for determining playing music from the user in operation S202. If the music playing application is executed and the screen 190 displays a playing music list prior to operation S202, the user may input a user input for selecting one of playing music included in the playing music list to the electronic device 100 in operation S202. In an embodiment, the user may determine playing music using the music playing application and input a user input for determining an instrument to be played to the electronic device 100. For example, the controller 110 may receive a user input for selecting 'Rachmaninov Piano Concerto #2' from among the playing music included in the playing music list from the user through the screen 190.

Once the playing music is determined, the controller 110 loads a guide track for the playing music from the storage unit 175 in operation S204. In an embodiment, the guide track loaded in operation S204 may be loaded as a reference sound candidate group including multiple reference sounds. In an embodiment, the controller 110 determines whether the guide track for the playing music is stored in the storage unit 175 and loads the stored guide track if the guide track is stored. If the guide track is not stored in the storage unit 175, the controller 110 may control the communication interface 102 to request and receive the guide track from another electronic device (for example, a server storing the guide track). According to an embodiment, if the guide track is not stored in the storage unit 175, the controller 110 may generate the guide track.

If the guide track is loaded, the controller 110 controls the multimedia module 140 to play the playing music in operation S206 and receives an input sound from the user in operation S208. In operation S206, the controller 110 may control the screen 190 to display at least one musical instrument selected by the user. Also, by playing sounds of other musical instruments than the musical instrument selected by the user, the playing music may be played. Generally, the playing music is played with one or more musical instruments. For example, suppose that the playing music is played with five musical instruments and the music playing application outputs sounds of five musical instruments. In the current embodiment, the user selects one of the five musical instruments and inputs a user input for selecting a sound of the selected musical instrument to the electronic device 100, thereby playing the musical instrument through the music playing application. The controller 110 may output a user playing sound of the four musical instruments that are not selected by the user from among the five musical instruments as background music through the speaker 163.

According to an embodiment, the electronic device 100 may play playing music also with an instrument the user desires to play. For example, it is assumed that the playing music is played with three musical instruments and the performance application is capable of outputting sounds of the three musical instruments. The controller 110 according to the current embodiment may play playing music by playing a sound of one musical instrument selected by the user and sounds of the other two musical instruments that are not selected by the user together.

In an embodiment, the electronic device 100 may skip operation S206. For example, if the user desires to play playing music merely with one musical instrument by using the performance application, that is, if the user desires to play only a device playing sound corresponding to an input sound, then the controller 110 may play only the device playing sound corresponding to the input sound as playing music, without playing separate background music.

Once the input sound is input, the controller 110 determines a reference sound that is closest to the input sound in operation S210. If the input sound and the reference sound are the same as each other, the controller 110 determines the input sound as the reference sound in operation S210. If the input sound and the reference sound are not the same as each other, the controller 110 determines a sound that is closest to the input sound as a reference sound.

Once the reference sound is determined, the controller 110 determines and plays the reference sound as a device playing sound in operation S212. That is, the speaker 163 outputs the reference sound determined in operation S210 as a device playing sound. For example, suppose that mi flat, fa, and sol sharp are included in a reference sound candidate group corresponding to an input sound 'fa sharp'. In operation S210, the controller 110 determines fa that is closest to fa sharp among reference sounds included in the reference sound candidate group as a device playing sound.

Figures 3A, 3B:
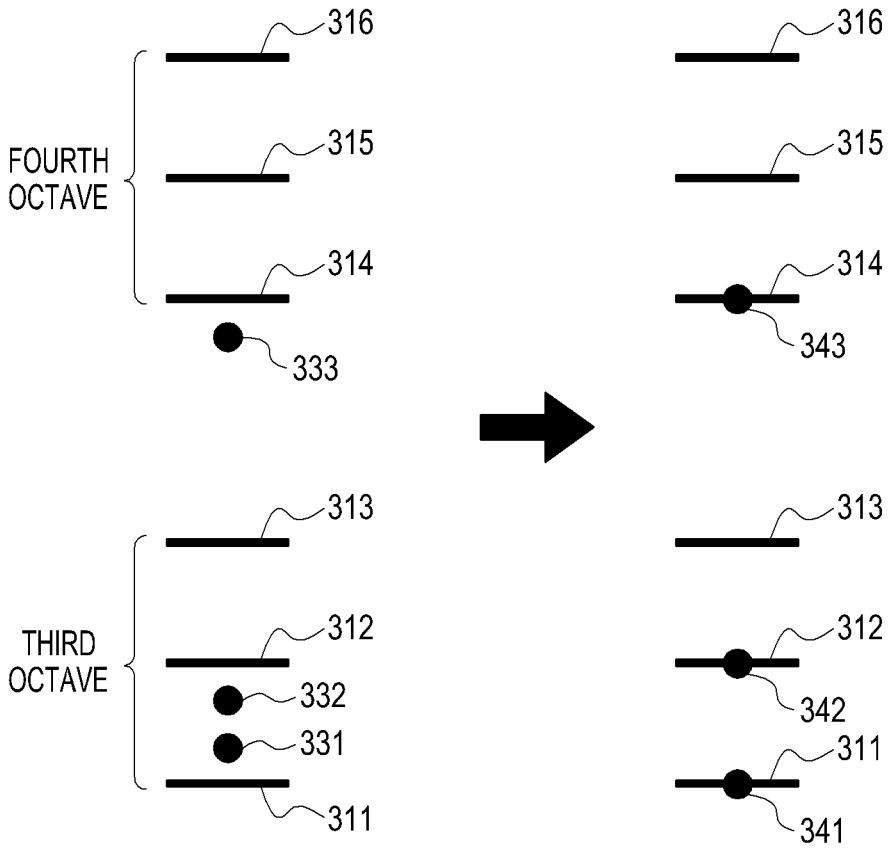
FIGS. 3A and 3B are diagrams illustrating a method for playing a piece of playing music or a playing song by using a method, for example, the method for controlling the electronic device illustrated in FIG. 2, according to an embodiment of the present disclosure.

FIGS. 3A and 3B are diagrams showing a method for playing a piece of playing music by using a method, for example, the method for controlling the electronic device illustrated in FIG. 2, according to an embodiment of the present disclosure.

Referring to FIGS. 3A and 3B, it is assumed that the user simultaneously inputs a first input sound 331, a second input sound 332, and a third input sound 333 to the screen 190 of the electronic device 100. FIG. 3A shows the input sounds 331, 332, and 333 input from the user and a reference sound candidate group including reference sounds 311, 312, 313, 314, 315, and 316, and FIG. 3B shows device playing sounds 341, 342, and 343 actually output corresponding to the input sounds 331, 332, and 333 through the speaker 163.

It is also assumed that the candidate reference sounds 311, 312, 313, 314, 315, and 316 corresponding to the first to third input sounds 331, 332, and 333 are distributed across a third octave and a fourth octave. The controller 110 determines the reference sounds 311, 312, and 314 corresponding to the first input sound 331, the second input sound 332, and the third input sound 333. The controller 110 determines the reference sound 311 closest to the first input sound 331 among the reference sounds 311, 312, 313, 314, 315, and 316 as the first device playing sound 341 corresponding to the first input sound 331. The controller 110 determines the reference sound 312 closest to the second input sound 332 among the reference sounds 311, 312, 313, 314, 315, and 316 as the second device playing sound 342 corresponding to the second input sound 332. The controller 110 determines the reference sound 314 closest to the third input sound 333 among the reference sounds 311, 312, 313, 314, 315, and 316 as the third device playing sound 343 corresponding to the third input sound 333. Once the device playing sounds 341, 342, and 343 are determined in this way, the controller 110 plays the device playing sounds 341, 342, and 343. That is, if the user simultaneously inputs the first to third input sounds 331, 332, and 333 to the electronic device 100, the speaker 163 of the electronic device 100 outputs the first to third device playing sounds 341, 342, and 343.

Figure 4:
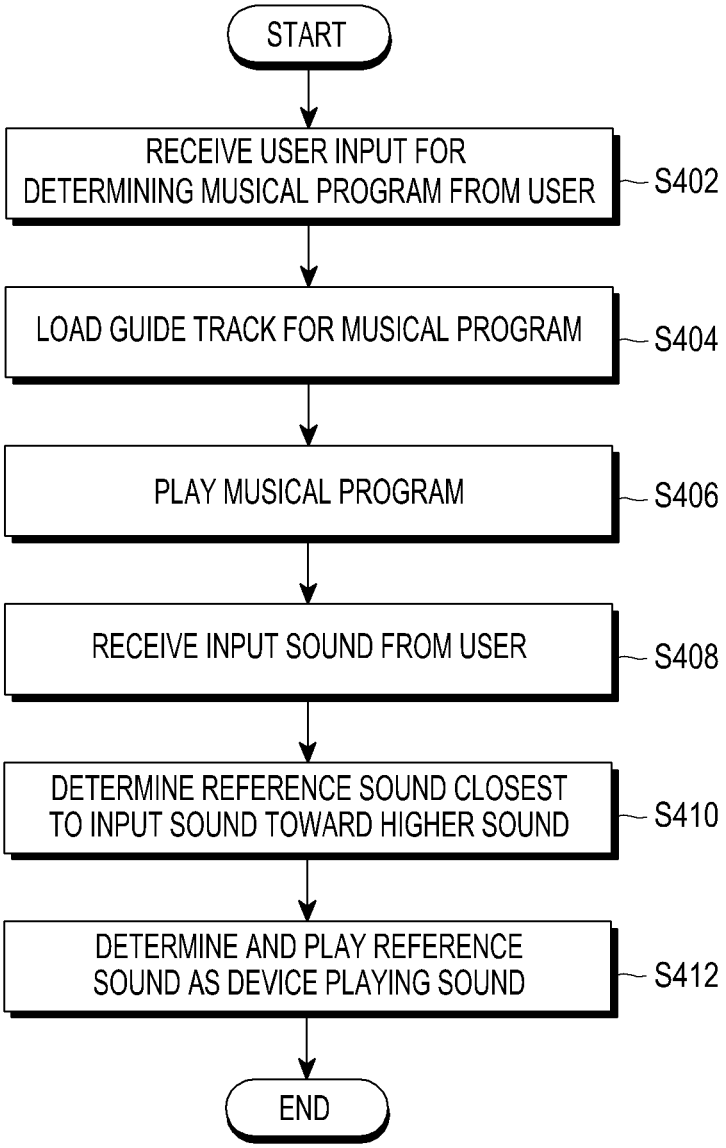
FIG. 4 is a flowchart illustrating another example of a method for controlling an electronic device, for example, the electronic device illustrated in FIG. 1, according to an embodiment of the present disclosure.

FIG. 4 is a flowchart illustrating another example of a method for controlling an electronic device, for example, the electronic device illustrated in FIG. 1, according to an embodiment of the present disclosure. As in FIG. 2, it is also assumed that the electronic device 100 is executing the performance application in FIG. 4.

Referring to FIG. 4, the electronic device 100 receives a user input for determining playing music from the user in operation S402. If the performance application is executed and the screen 190 displays a playing music list prior to operation S402, then the user may input a user input for selecting one of playing music included in the playing music list to the electronic device 100 in operation S402. In an embodiment, in operation S402, after determining the playing music using the performance application, the user may input a user input for determining an instrument to be played to the electronic device 100.

Once the playing music is determined, the controller 110 loads a guide track for the playing music from the storage unit 175 in operation S404. In an embodiment, the guide track loaded in operation S404 may be loaded as a reference sound candidate group including multiple reference sounds. According to an embodiment, the controller 110 determines whether a guide track for the playing music is stored in the storage unit 175, and if the guide track is stored in the storage unit 175, the controller 110 loads the stored guide track. If the guide track is not stored in the storage unit 175, the controller 110 controls the communication interface 102 to request and receive the guide track from another electronic device (for example, a server storing the guide track). According to an embodiment, if the guide track is not stored in the storage unit 175, the controller 110 may generate the guide track.

Once the guide track is loaded, the controller 110 controls the multimedia module 140 to play the playing music in operation S406 and receives an input sound from the user in operation S408. In operation S406, the controller 110 may control the screen 190 to display at least one musical instrument selected by the user. The controller 110 may also device playing sounds of other musical instruments than the user-selected musical instrument to play the playing music. The controller 110 may output user playing sounds of the musical instruments that are not selected by the user among musical instruments capable of playing the playing music as background music through the speaker 163.

In an embodiment, the electronic device 100 may skip operation S406. For example, if the user desires to play playing music merely with one musical instrument by using the performance application, that is, to play a device playing sound corresponding to an input sound, the controller 110 then may play only the device playing sound corresponding to the input sound without playing separate background music.

Once the input sound is input, the controller 110 determines a reference sound closest to the input sound toward a higher sound in operation S410. In an embodiment, if the input sound and the reference sound are the same as each other, the controller 110 determines the input sound as the reference sound. If the input sound and the reference sound are not the same as each other, the controller 110 determines a sound closest to the input sound toward a higher sound as a reference sound.

Once the reference sound is determined in this way, the controller 110 determines and plays the reference sound as a device playing sound in operation S412. That is, the speaker 163 outputs the reference sound determined in operation S410 as a device playing sound.

For example, suppose that sol and sol sharp are included in a reference sound candidate group corresponding to an input sound 'fa sharp'. In operation S410, the controller 110 determines sol that is closest to fa sharp toward a higher sound among reference sounds included in the reference sound candidate group.

Figures 5A, 5B:
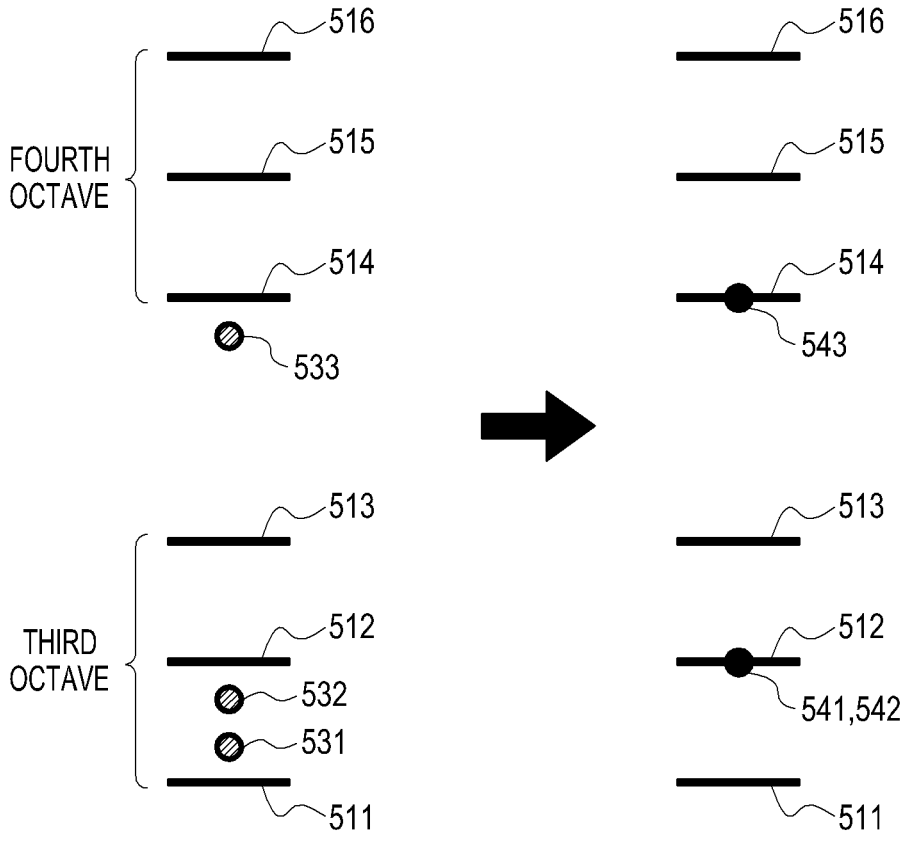
FIGS. 5A and 5B are diagrams illustrating a method for playing a piece of playing music by using a method, for example, the method for controlling the electronic device illustrated in FIG. 4, according to an embodiment of the present disclosure.

FIGS. 5A and 5B are diagrams showing a method for playing a piece of playing music by using a method, for example, the method for controlling the electronic device illustrated in FIG. 4, according to an embodiment of the present disclosure.

Referring to FIGS. 5A and 5B, it is assumed that the user simultaneously inputs a first input sound 531, a second input sound 532, and a third input sound 533 to the screen 190 of the electronic device 100. FIG. 5A shows the input sounds 531, 532, and 533 input from the user and a reference sound candidate group including reference sounds 511, 512, 513, 514, 515, and 516. FIG. 5B shows device playing sounds 541, 542, and 543 that are actually output corresponding to the input sounds 531, 532, and 533 through the speaker 163.

It is also assumed that the candidate reference sounds 511, 512, 513, 514, 515, and 516 corresponding to the first to third input sounds 531, 532, and 533 are distributed across the third octave and the fourth octave. The controller 110 determines the reference sound 512 corresponding to the first input sound 531 and the second input sound 532 and the reference sound 514 corresponding to the third input sound 533. The controller 110 determines the reference sound 512 that is closest to the first input sound 531 toward a higher sound among the reference sounds 511, 512, 513, 514, 515, and 516 as the first device playing sound 541 corresponding to the first input sound 531. The controller 110 determines the reference sound 512 that is closest to the second input sound 532 among the reference sounds 511, 512, 513, 514, 515, and 516 as the second device playing sound 542 corresponding to the second input sound 532. The controller 110 determines the reference sound 514 that is closest to the third input sound 533 toward a higher sound among the reference sounds 511, 512, 513, 514, 515, and 516 as the third device playing sound 543 corresponding to the third input sound 533. Once the device playing sounds 541, 542, and 543 are determined in this way, the controller 110 plays the device playing sounds 541, 542, and 543. That is, if the user simultaneously inputs the first input sound 531, the second input sound 532, and the third input sound 533 to the electronic device 100, the speaker 163 of the electronic device 100 outputs the first device playing sound 541, the second device playing sound 542, and the third device playing sound 543.

Referring to FIG. 5B, the first device playing sound 541 corresponding to the first input sound 531 and the second device playing sound 542 corresponding to the second input sound 532 are the same sound. In this case, the controller 110 may control the speaker 163 to output only the first device playing sound 541 and the third device playing sound 543 corresponding to the first to third input sounds 531, 532, and 533.

Figure 6:
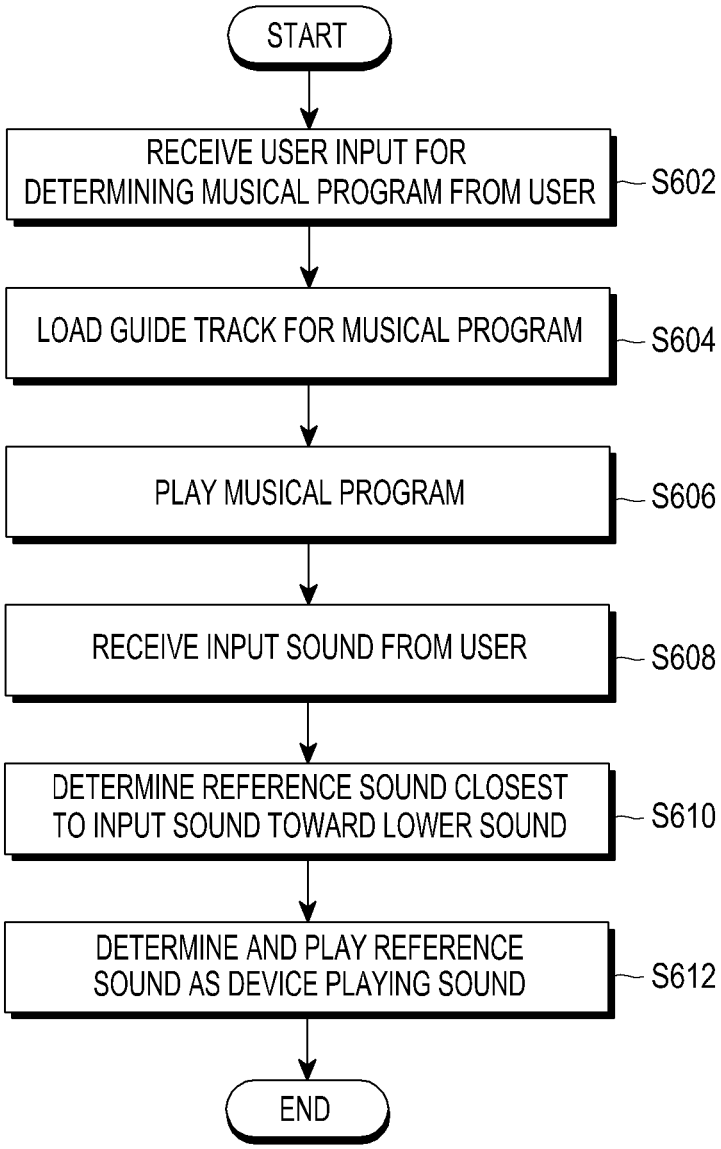
FIG. 6 is a flowchart illustrating further another example of a method for controlling an electronic device, for example, the electronic device illustrated in FIG. 1, according to an embodiment of the present disclosure.

FIG. 6 is a flowchart illustrating further another example of a method for controlling an electronic device, for example, the electronic device illustrated in FIG. 1, according to an embodiment of the present disclosure. As in FIG. 2, suppose that the electronic device 100 is executing the performance application in FIG. 6.

Referring to FIG. 6, an electronic device 100 receives a user input for determining playing music from the user in operation S602. If the performance application is executed and thus the screen 190 displays a playing music list prior to operation S602, the user may input a user input for selecting one of playing music included in the playing music list to the electronic device 100 in operation S602. In an embodiment, in operation S602, after determining the playing music using the performance application, the user may input a user input for determining an instrument to be played to the electronic device 100.

Once the playing music is determined, the controller 110 loads a guide track for the determined playing music from the storage unit 175 in operation S604. In an embodiment, the guide track loaded in operation S604 may be loaded as a reference sound candidate group including multiple reference sounds. In an embodiment, the controller 110 determines whether a guide track for the playing music is stored in the storage unit 175, and if the guide track is stored in the storage unit 175, the controller 110 loads the guide track from the storage unit 175. If the guide track is not stored in the storage unit 175, the controller 110 may control the communication interface 102 to request and receive the guide track from another electronic device (for example, a server storing the guide track). In an embodiment, if the guide track is not stored in the storage unit 175, the controller 110 may generate the guide track.

Once the guide track is generated, the controller 110 controls the multimedia module 140 to play the playing music in operation S606 and receives an input sound from the user in operation S608. In operation S606, the controller 110 may control the screen 190 to display at least one musical instrument selected by the user. The playing music may also be played by playing of sounds of other musical instruments than the musical instrument selected by the user. In this case, the controller 110 may output, as background music, user playing sounds of musical instruments that are not selected by the user among musical instruments capable of playing the playing music, through the speaker 163.

In an embodiment, the electronic device 100 may skip operation S606. For example, if the user desires to play the playing music merely with one musical instrument by using the performance application, that is, the user desires to play a device playing sound corresponding to an input sound, the controller 110 may play, as the playing music, the device playing sound corresponding to the input sound without playing separate background music.

Upon input of the input sound, the controller 110 determines a reference sound that is closest to the input sound toward a lower sound in operation S610. In an embodiment, if the input sound and the reference sound are the same as each other, the controller 110 may determine the input sound as the reference sound in operation S610. If the input sound and the reference sound are not the same as each other, the controller 110 may determine a sound that is closest to the input sound toward a lower sound as the reference sound.

Once the reference sound is determined in this way, the controller 110 determines and plays the reference sound as the device playing sound in operation S612. That is, the speaker 163 outputs the reference sound determined in operation S610 as a device playing sound. For example, suppose that a reference sound candidate group corresponding to an input sound 'fa sharp' includes mi and fa. In operation S610, the controller 110 determines, as a device playing sound, fa that is closest to fa sharp toward a lower sound among reference sounds included in the reference sound candidate group.

Figure 7A:
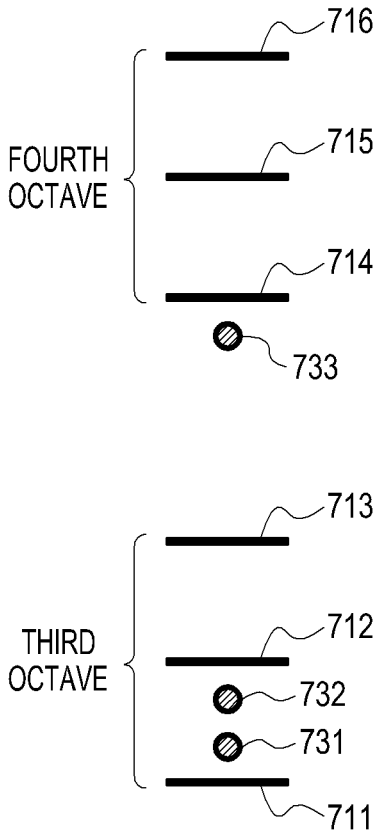
FIGS. 7A and 7B are diagrams illustrating a method for playing a piece of playing music by using a method, for example, the method for controlling the electronic device illustrated in FIG. 6, according to an embodiment of the present disclosure.
Figure 7B:
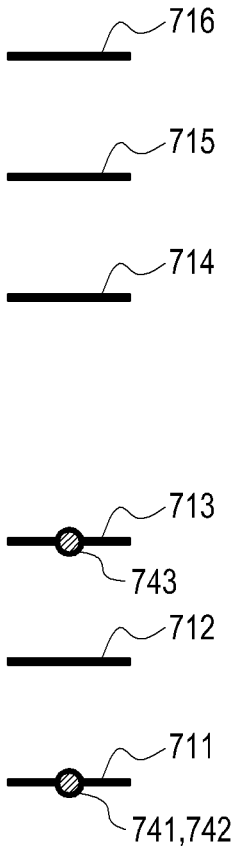

FIGS. 7A and 7B are diagrams showing a method for playing a piece of playing music by using a method, for example, the method for controlling the electronic device illustrated in FIG. 6, according to an embodiment of the present disclosure.

Referring to FIGS. 7A and 7B, it is assumed that the user simultaneously inputs a first input sound 731, a second input sound 732, and a third input sound 733 to the screen 190 of the electronic device 100. FIG. 7A shows the input sounds 731, 732, and 733 input from the user and a reference sound candidate group including reference sounds 711, 712, 713, 714, 715, and 716, and FIG. 7B shows device playing sounds 741, 742, and 743 that are actually output corresponding to the input sounds 731, 732, and 733 through the speaker 163.

It is also assumed that the candidate reference sounds 711, 712, 713, 714, 715, and 716 corresponding to the first through third input sounds 731, 732, and 733 are distributed across the third octave and the fourth octave. The controller 110 determines the reference sound 711 corresponding to the first input sound 731 and the second input sound 732 and the reference sound 713 corresponding to the third input sound 733. The controller 110 determines the reference sound 711 that is closest to the first input sound 731 toward a lower sound among the reference sounds 711, 712, 713, 714, 715, and 716 as a first device playing sound 741 corresponding to the first input sound 731. The controller 110 determines the reference sound 711 that is closest to the second input sound 732 toward a lower sound among the reference sounds 711, 712, 713, 714, 715, and 716 as a second device playing sound 742 corresponding to the second input sound 732. The controller 110 determines the reference sound 713 that is closest to the third input sound 733 toward a lower sound among the reference sounds 711, 712, 713, 714, 715, and 716 as a third device playing sound 743 corresponding to the third input sound 733. Once the device playing sounds are 741, 742, and 743 are determined, the controller 110 plays the device playing sounds 741, 742, and 743. That is, if the user simultaneously inputs the first to third input sounds 731, 732, and 733 to the electronic device 100, the speaker 163 of the electronic device 100 outputs the first to third device playing sounds 741, 742, and 743.

Referring to FIG. 7B, the first device playing sound 741 corresponding to the first input sound 731 and the second device playing sound 742 corresponding to the second input sound 732 are the same sound. In this case, the controller 110 may control the speaker 163 to output the first device playing sound 741 and the third device playing sound 743 corresponding to the first to third input sounds 731, 732, and 733.

Figure 8:
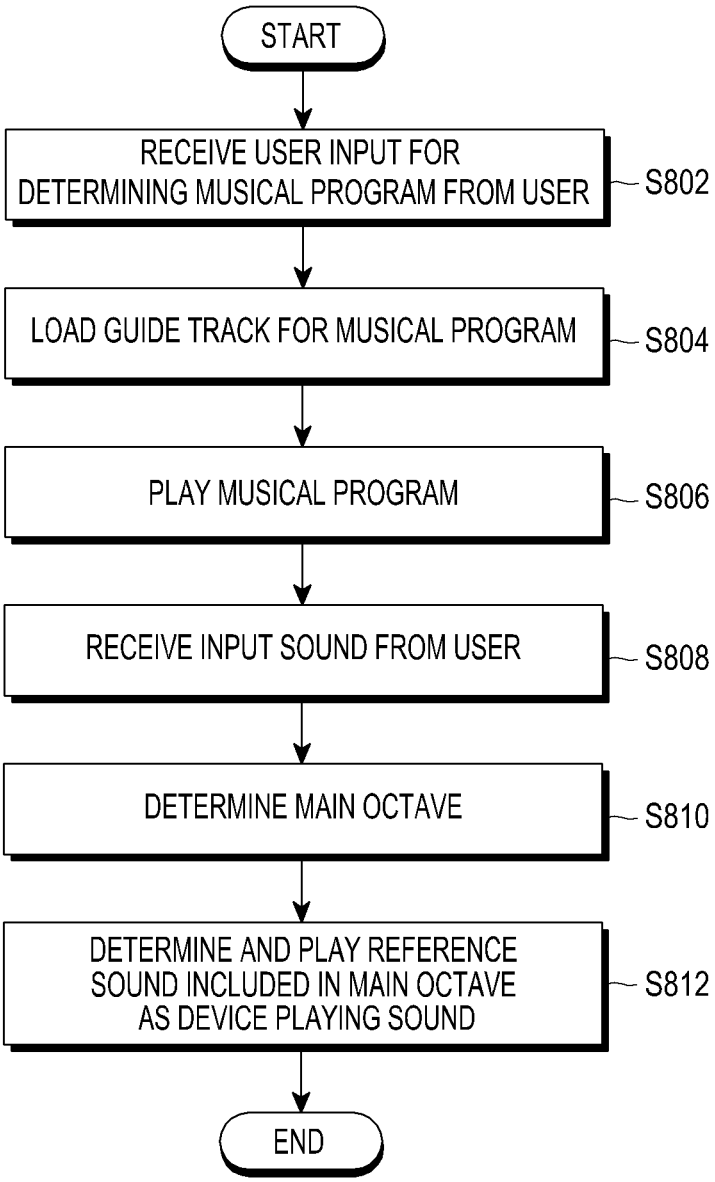
FIG. 8 is a flowchart illustrating yet another example of a method for controlling an electronic device, for example, the electronic device illustrated in FIG. 1, according to an embodiment of the present disclosure.

FIG. 8 is a flowchart illustrating yet another example of a method for controlling an electronic device illustrated in FIG. 1 according to an embodiment of the present disclosure. As in FIG. 2, it is assumed that an electronic device 100 is executing the performance application in FIG. 8. In the current embodiment, the user inputs a plurality of input sounds at the same time.

Referring to FIG. 8, the electronic device 100 receives a user input for determining playing music from the user in operation S802. If the performance application is executed and thus the screen 190 displays a playing music list prior to operation S802, the user may input a user input for selecting one of playing music included in the playing music list to the electronic device 100 in operation S802. In an embodiment, in operation S802, after determining playing music using the performance application, the user may input a user input for determining an instrument to be played to the electronic device 100.

Once the playing music is determined, the controller 110 generates a guide track for the playing music in operation S804. In an embodiment, the guide track generated in operation S804 may be generated as a reference sound candidate group including multiple reference sounds.

Once the guide track is generated, the controller 110 controls the multimedia module 140 to play the playing music in operation S806 and receives an input sound from the user in operation S808. In operation S806, the controller 110 may control the screen 190 to display at least one musical instrument selected by the user. The playing music may also be played by playing of sounds of other musical instruments than the musical instrument selected by the user. The controller 110 may output, as background music, user playing sounds of musical instruments that are not selected by the user among musical instruments capable of playing the playing music, through the speaker 163.

In an embodiment, the electronic device 100 may skip operation S806. For example, if the playing music may be played merely with one musical instrument, separate background music may not be generated, such that the controller 110 plays only device playing sounds corresponding to input sounds as the playing music.

Upon input of the input sounds, the controller 110 determines an octave including the input sounds, that is, a main octave in operation S810. For example, suppose that three input sounds are input at the same time in operation S808. It is also assumed that two of the three input sounds are included in a second octave and the other sound is included in the third octave. In operation S810, the controller 110 may determine the second octave including two of the three input sounds as the main octave.

Once the main octave is determined, the controller 110 determines and plays reference sounds included in the main octave as device playing sounds in operation S812. In an embodiment, the controller 110 may determine, as a device playing sound, a reference sound that is closest to the input sound among the reference sounds included in the main octave. The controller 110 may also determine, as a device playing sound, the reference sound that is closest to the input sound toward a higher sound among the reference sounds included in the main octave. In an embodiment, the controller 110 may also determine, as a device playing sound, a reference sound that is closest to the input sound toward a lower sound among the reference sounds included in the main octave. Once the device playing sound is determined, the controller 110 controls the speaker 163 to play the determined device playing sound.

Figure 9A:
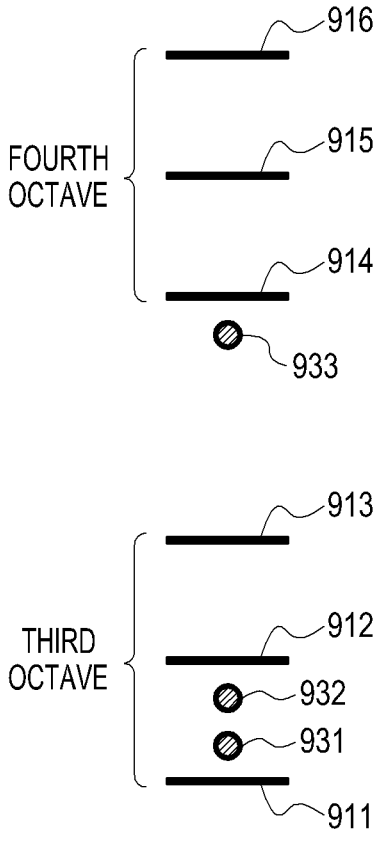
FIGS. 9A and 9B are diagrams illustrating a method for playing a playing song by using a method, for example, the method for controlling the electronic device illustrated in FIG. 8, according to an embodiment of the present disclosure.
Figure 9B:
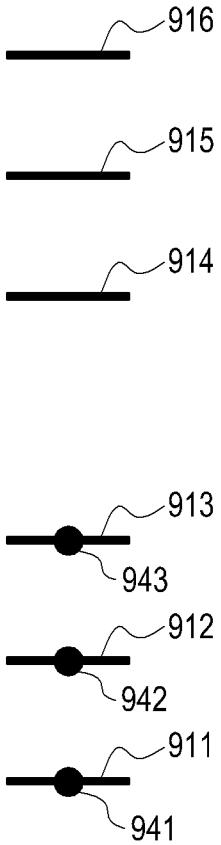

FIGS. 9A and 9B are diagrams illustrating a method for playing a piece of playing music by using the method for controlling the electronic device illustrated in FIG. 8 according to an embodiment of the present disclosure.

Referring to FIGS. 9A and 9B, suppose that the user simultaneously inputs a first input sound 931, a second input sound 932, and a third input sound 933 to the screen 190 of the electronic device 100. In the current embodiment, it is also assumed that the controller 110 determines a reference sound that is closest to an input sound among reference sounds included in a main octave as a device playing sound.

FIG. 9A shows the input sounds 931, 932, and 933 input from the user and a reference sound candidate group including reference sounds 911, 912, 913, 914, 915, and 916. FIG. 9B shows device playing sounds 941, 942, and 943 that are actually output corresponding to the input sounds 931, 932, and 933 through the speaker 163.

It is assumed that the reference sounds 911, 912, 913, 914, 915, and 916 included in the reference sound candidate group corresponding to the first to third input sounds 931, 932, and 933 are distributed across the third octave and the fourth octave. The controller 110 performs analysis to determine in which octave each of the first input sound 931, the second input sound 932, and the third input sound 933 is included. Referring to FIGS. 9A and 9B, the first input sound 931 and the second input sound 932 are included in the third octave and the third input sound 933 is included in the fourth octave. Thus, the main octave of the first to third input sounds 931, 932, and 933 is the third octave. The controller 110 also determines the reference sounds 911, 912, and 913 corresponding to the first input sound 931, the second input sound 932, and the third input sound 933, respectively. The controller 110 determines the reference sound 911 closest to the first input sound 931 among the reference sounds 911, 912, and 913 included in the third octave that is the main octave, as the first device playing sound 941 corresponding to the first input sound 931. The controller 110 determines the reference sound 912 that is closest to the second input sound 932 among the reference sounds 911, 912, and 913 included in the third octave that is the main octave, as the second device playing sound 942 corresponding to the second input sound 932. The controller 110 determines the reference sound 913 that is closest to the third input sound 933 among the reference sounds 911, 912, and 913 included in the third octave that is the main octave, as the third device playing sound 943 corresponding to the third input sound 933.

Once the device playing sounds 941, 942, and 943 are determined, the controller 110 plays the device playing sounds 941, 942, and 943. That is, if the user simultaneously inputs the first to third input sounds 931, 932, and 933 to the electronic device 100, the speaker 163 of the electronic device 100 outputs the first to third device playing sounds 941, 942, and 943 as shown in FIG. 9B.

As is apparent from the foregoing description, with the electronic device and the method for controlling the electronic device according to the present disclosure, even the novice user who is not familiar with playing an instrument may easily play the music.

It may be seen that the various embodiments of the present disclosure may be implemented with hardware, software, or a combination of hardware and software. Such arbitrary software may be stored, whether or not erasable or re-recordable, in a volatile or non-volatile storage such as a Read-Only Memory (ROM); a memory such as a Random Access Memory (RAM), a memory chip, a device, or an integrated circuit; and an optically or magnetically recordable and machine (for example, computer)-readable storage medium such as a Compact Disc (CD), a Digital Versatile Disk (DVD), a magnetic disk, or a magnetic tape. It may be seen that the method for controlling the electronic device according to the present disclosure may be implemented by a computer or a portable terminal which includes a controller and a memory, and the memory is an example of a machine-readable storage medium which is suitable for storing a program or programs including instructions for implementing the various embodiments of the present disclosure. Therefore, the present disclosure includes a program including codes for implementing an apparatus or method claimed in an arbitrary claim and a machine (for example, computer)-readable storage medium for storing such a program. The program may be electronically transferred through an arbitrary medium such as a communication signal delivered through wired or wireless connection, and the present disclosure properly includes equivalents thereof.

The electronic device may receive and store the program from a program providing device connected in a wired or wireless manner. The program providing device may include a memory for storing a program including instructions for instructing the electronic device to execute the claimed method for controlling the electronic device, information necessary for the method for controlling the electronic device, a communication unit for performing wired or wireless communication with the electronic device, and a controller for transmitting a corresponding program to the electronic device at the request of the electronic device or automatically.

Other effects that may be obtained or expected from the embodiment of the present disclosure are explicitly or implicitly disclosed in the detailed description of the embodiment of the present disclosure. That is, various effects expected from the embodiment of the present disclosure have been disclosed in the detailed description of the present disclosure.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. A method for playing music by an electronic device, the method comprising:

if a musical program to be played is determined, and at least one input sound is received, determining a first instrument corresponding to the at least one input sound and second instruments other than the first instrument from among one or more instruments for the music program;

loading a guide track corresponding to the first instrument based on the music program;

determining one of a plurality of reference sounds included in the guide track as a playing sound corresponding to the at least one input sound; and outputting the playing sound and background music played by the second instruments.

2. The method of claim 1, wherein the determining of the one of the plurality of reference sounds included in the guide track as the playing sound corresponding to the at least one input sound comprises determining, as the playing sound, a reference sound that is the same as the at least one input sound among the plurality of reference sounds.

3. The method of claim 1, wherein the determining of the one of the plurality of reference sounds included in the guide track as the playing sound corresponding to the at least one input sound comprises determining, as the playing sound, a reference sound that is closest to the at least one input sound among the plurality of reference sounds.

4. The method of claim 1, wherein the determining of the one of the plurality of reference sounds included in the guide track as the playing sound corresponding to the at least one input sound comprises determining, as the playing sound, a reference sound that is closest to the at least one input sound toward a higher sound among the plurality of reference sounds.

5. The method of claim 1, wherein the determining of the one of the plurality of reference sounds included in the guide track as the playing sound corresponding to the input sound comprises determining, as the playing sound, a reference sound that is closest to the at least one input sound toward a lower sound among the plurality of reference sounds.

6. The method of claim 1, wherein the determining of the one of the plurality of reference sounds included in the guide track as the playing sound corresponding to the input sound comprises:

determining an octave comprising most of the at least one input sound as a main octave; and determining one of reference sounds included in the main octave as the playing sound.

7. The method of claim 6, wherein the determining of the one of the reference sounds included in the main octave as the playing sound comprises determining, as the playing sound, a sound that is closest to the at least one input sound among the reference sounds included in the main octave.

8. The method of claim 6, wherein the determining of the one of the reference sounds included in the main octave as the playing sound comprises determining, as the playing sound, a sound that is closest to the at least one input sound toward a higher sound among the reference sounds included in the main octave.

9. The method of claim 6, wherein the determining of the one of the reference sounds included in the main octave as the playing sound comprises determining, as the playing sound, a sound that is closest to the at least one input sound toward a lower sound among the reference sounds included in the main octave.

10. The method of claim 1, further comprising:

generating, prior to the receiving of the at least one input sound from the user, the guide track corresponding to the first instrument.

11. The method of claim 1, further comprising:

receiving, prior to the receiving of the at least one input sound from the user, the guide track corresponding to the first instrument from another electronic device.

12. An electronic device for playing music comprising:

a controller configured to:

if a musical program to be played is determined, and at least one input sound is received, determine a first instrument corresponding to the at least one input sound and second instruments other than the first instrument from among one or more instruments for the music program, load a guide track corresponding to the first instrument based on the music program, and determine one of a plurality of reference sounds included in the guide track as a playing sound corresponding to the at least one input sound; and a speaker configured to output the playing sound and background music played by the second instruments.

13. The electronic device of claim 12, wherein the controller is further configured to determine, as the playing sound, a reference sound that is the same as the at least one input sound among the plurality of reference sounds.

14. The electronic device of claim 12, wherein the controller is further configured to determine, as the playing sound, a reference sound that is closest to the at least one input sound among the plurality of reference sounds.

15. The electronic device of claim 12, wherein the controller is further configured to determine, as the playing sound, a reference sound that is closest to the at least one input sound toward a higher sound among the plurality of reference sounds.

16. The electronic device of claim 12, wherein the controller is further configured to determine, as the playing sound, a reference sound that is closest to the at least one input sound toward a lower sound among the plurality of reference sounds.

17. The electronic device of claim 12, wherein the controller is further configured to:

determine an octave comprising most of the at least one input sound as a main octave, and determine one of reference sounds included in the main octave as the playing sound.

18. The electronic device of claim 17, wherein the controller is further configured to determine, as the playing sound, a sound that is closest to the at least one input sound among the reference sounds included in the main octave.

19. The electronic device of claim 17, wherein the controller is further configured to determine, as the playing sound, a sound that is closest to the at least one input sound toward a higher sound among the reference sounds included in the main octave.

20. The electronic device of claim 17, wherein the controller is further configured to determine, as the playing sound, a sound that is closest to the at least one input sound toward a lower sound among the reference sounds included in the main octave.

21. The electronic device of claim 12, wherein the controller is further configured to generate the guide track, before receiving the input sound.

22. The electronic device of claim 12, further comprising:

a communication interface configured to receive the guide track from another electronic device, before the input sound is received.

23. The electronic device of claim 17, wherein the controller is further configured to:

determine the octave comprising most of the at least one input sound as the main octave, and determine one of reference sounds included in the main octave as the playing sound if the at least one input sound includes at least two input sounds from at least two separate instruments.

* * * * *